United States Patent [19]

Merlino

[11] 4,119,799

[45] Oct. 10, 1978

[54] CRITICAL ALIGNMENT LOUDSPEAKER SYSTEM

[76] Inventor: Mark F. Merlino, 12211 Ferrari La., Garden Grove, Calif. 92641

[21] Appl. No.: 862,952

[22] Filed: Dec. 21, 1977

[51] Int. Cl.[2] ..... H04R 1/20

[52] U.S. Cl. ..... 179/1 E; 179/1 GA; 181/144; 181/146; 181/147

[58] Field of Search ..... 179/1 E, 1 GA; 181/144, 181/145, 146, 147

*Primary Examiner*—George G. Stellar
*Attorney, Agent, or Firm*—George W. Finch

[57] ABSTRACT

A loudspeaker cabinet system wherein at least two low frequency drivers of equal effective diameters are critically spaced a vertical distance which equals the effective piston diameter of one driver times $\pi$. When so placed, the respective spherical wave fronts of the drivers interfere causing a composite elliptical wave front which being flatter than the spheric can reflect from walls without drastically changing its shape to produce a uniform field which reaches the listener without producing any areas of the room which appear acoustically dead. Such system is especially useful in small rooms having reflective wall surfaces. Once the low frequency drivers are critically spaced and aligned, a higher frequency speaker or array of higher frequency speakers can be positioned thereabout without destroying the quality thereof.

25 Claims, 6 Drawing Figures

CRITICAL ALIGNMENT LOUDSPEAKER SYSTEM

BACKGROUND OF THE INVENTION

Some years ago, sound reproduction equipment went through a revolution and hi-fidelity and stereo sound equipment became available for use in homes and other places where only a relatively small size listening room was available. The electronics of such equipment has progressed now to such a point that the component of most stereo systems that limits the realism of the system is the loudspeaker system. This is because it has been very difficult to mechanically move air in a small room to reproduce the acoustic effects of the original material which were usually created in a large music hall or a studio especially treated to reduce wall reflections. In most homes, hi-fidelity equipment is placed in small rooms with very reflective walls and at levels where psycho-acoustics begin to take effect. Standing waves form in the room to produce interference in the form of variable increases in pressure at different areas of the room as the frequency range of the reproduced sound changes. These interference effects are likely to be very bad in the prime listening area between the two speaker enclosures of a stereo type hi-fidelity system and are extremely distracting at normal listening levels of 90 dba. To the listener the interference effects make it appear that some frequencies are continuously dropping out. This causes listener fatigue which is the prime reason that most people dislike "loud music" when reproduced by a stereo hi-fidelity system. Even people who have owned conventional stereo equipment for years must limit the period of time that they can listen to recorded multiple frequency sounds at normal listening levels.

The fatigue inducing effects can be greatly reduced by listening in an anechoic chamber or very dead environment where there are no reflections and hence very small interference effects. Except for the very wealthy, such rooms are out of the question and therefore there has been a need to produce a speaker system with a smooth response that has no peaks or resonances in the overall output and which can accommodate a small reflective room. Being frustrated with conventional speaker systems, others have tried to find a way to correct rooms electronically. Unfortunately, this approach results in complicated losses in the signal path reducing the accuracy of the program before it reaches the speakers. The present critical alignment loudspeaker systems do not react drastically with a room and present a working alternative to solve the room-sound interaction problem.

BRIEF DESCRIPTION OF THE PRESENT INVENTION

The present invention is an improved loudspeaker system which is useful for high accuracy sound reproduction in hi-fidelity and stereo-hi-fidelity applications. The system which usually includes two mirror image cabinets has as an important element, the critical alignment of two or more low frequency drivers of similar size which are mounted in a common plane, a distance vertically apart which is the effective piston diameter one driver times the universal constant, $\pi$. The mathematical talents of Loring Manley were used by the inventor to simplify the critical alignment formula to its present form.

When the two drivers are placed using the aforementioned critical alignment, their respective spherical wave fronts interfere causing a composite elliptical wave front to be produced. Since this wave front is flatter than the normal spheric wave fronts from single speakers, it can reflect from walls without drastically changing its shape. This uniform field reaches the listener who can move about the room in which the speakers are positioned without noticing any dead spots or standing waves which are normally caused by other types of speaker systems. When placed in such critical alignment, dual drivers are capable of producing realistic transient and ambient sounds at the pressure levels of much larger drivers and with the fast attack time of comparably sized drivers. The net effect is the present dual driver system responds at the speed of a small driver while being able to move a volume of air at equivalent pressure to a larger driver.

The critical alignment system can include only two drivers, or other high frequency components can be added. When added to the system, a cone driver can be positioned in each cabinet for midrange frequencies. It is preferable that the cone driver is placed off axis from the vertical alignment of the low frequency drivers to prevent Doppler effects. When pairs of speaker cabinets are employed, the cone drivers preferably are positioned in a mirror image relationship in the two cabinets. The cone high frequency driver usually is mounted above the top low frequency driver and offset by a value of $\frac{3}{8}\pi$ times the effective diameter of the driver, whereas a filler driver, when needed, usually is mounted above the horizontal plane of the top low frequency driver opposite the cone driver and equally distant from the top and adjacent side of the cabinet. It is preferable that these latter distances are one half the diameter of the filler driver. The filler driver is included when the system designer wishes to enhance field effect and eliminate beaming.

A dome driver for reproducing even higher frequencies can be mounted between the low frequency drivers and on the axis therebetween because dome drivers exhibit polar dispersion.

The cabinet in which all the drivers are mounted in the present invention has a volume which is non-critical since the cabinet does not serve as a tuned chamber, and interior bulkheads can be located inside the cabinet between the two low frequency drivers to effectively de-tune the cabinet. Although it can have a relatively large proportion of open area to closed area, the bulkhead is utilized to eliminate standing waves which otherwise might occur in the enclosure. To prevent sympathetic chiming at the higher frequencies, the enclosure is also damped liberally by suitable damping materials such as glass wool and is vented in the rear by means of tapered ports to prevent cabinet pressurization by the low frequency drivers. The required number of ports is dictated by the capability by the low frequency drivers to move air and thus depends upon the drivers chosen. The above described speaker-cabinet arrangement allows the low frequency drivers to approach their natural resonant frequency making the enclosure an effective infinite baffle. The enclosure is believed to serve no purpose other than to support the drivers in the proper dimensional relationship and to absorb the back waves from the low frequency drivers.

It is therefore an object of the present invention to produce a system for vibrating air at acoustic frequencies in such a manner that realistic reproduction of the original sound can occur in small, acoustically hard rooms.

Another object of the present invention is to provide a loudspeaker system which can realistically produce sound with relatively low cost components.

Another object of the present invention is to provide a system by which the reproduction of sound can be improved no matter what the diameter of the low frequency drivers of the system.

Another object of the present invention is to reduce as far as possible undesirable effects such as dead spots and beaming without resort to electronic trickery.

Another object is to provide loudspeaker systems which can be used in pairs to produce realistic imaging of the original sound material in a conventional household.

These and other objects and advantages of the present invention will become apparent to those familiar with the art after considering the following detailed specification which describes preferred embodiments thereof in conjunction with the accompanying drawings wherein.

DETAILED DESCRIPTION OF THE SHOWN EMBODIMENTS

Figure 1:
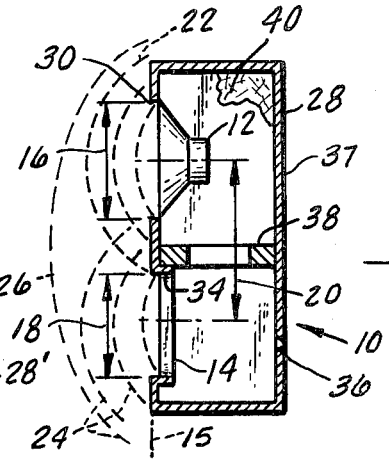
FIG. 1, is a cross-sectional view of the loud speaker system showing the critical dimensional relationships of the present invention.

Referring to the drawings, more particularly by reference numbers, number 10 in FIG. 1 refers to a speaker enclosure constructed according to the present invention. The enclosure 10 includes a pair of low frequency drivers 12 and 14, vertically aligned on the same plane 15. The driver 12 is shown as being a relatively conventional cone driver whereas driver 14 is shown as a flat plate passive radiator. Normally, identical drivers would be used in the enclosure 10 but the present invention does not require such, it only requiring that the effective diameters 16 and 18 of the drivers 12 and 14 be generally identical. When such is the case, the drivers 12 and 14 are located in the enclosure 10 in vertical alignment at a distance 20 which is the universal constant $\pi$ times the effective diameter of either one of the drivers.

Drivers normally produced spherical acoustic wave fronts and by so locating the drivers 12 and 14 as shown, the respective spherical wave fronts 22 and 24 thereof interfere causing the production of composite elliptical wave fronts 26. Since the elliptical wave fronts 26 are flatter than the spherical wave fronts 22 and 24, they can reflect from walls of the room in which the speaker enclosure 10 is placed, without drastically changing shape. This produces a uniform field of sound without appreciable dead spots caused by standing waves so that the listener can move about the room without appreciably changing the perceived sound content. Therefore, a sound system employing speaker systems such as 10 can be used in any listening environment since there is no reliance on the room for any augmentation at any frequency nor are there cancellation problems due to standing waves.

It should be realized that although the above formula represents what appears from tests to be the optimum spacing, production tolerances must be allowable so the invention is commercially producable. User tests have shown that audible differences appear when the critical alignment distance varies plus or minus five percent. A system outside these tolerances sounds poor in dispersion due to uneven sound field. The most obvious range is in the 500 to 800 Hz frequencies. From preliminary production tests, it appears that the production tolerance allowable varies with driver diameter as a five percent error in a system employing 2.125 inch piston diameter speakers was audibly obvious, whereas a similar error in a system employing piston diameters of 5.75 inches was barely noticeable.

The enclosure cabinet 28 can be constructed of any suitable structural material such as wood, particle board or vinyl plastic. It is preferably that the cabinet 28 includes, in addition to openings 30 and 34 for the drivers 12 and 14, at least one tapered opening 36 in the back wall 37 behind the drivers 12 and 14 to prevent them from pressurizing the cabinet 28. It is also preferable to include a baffle 38 to partially restrict the area within the cabinet 28 between the two speakers 12 and 14. This, along with insulation material 40 helps to prevent standing waves and resonances within the cabinet 28.

Figure 2:
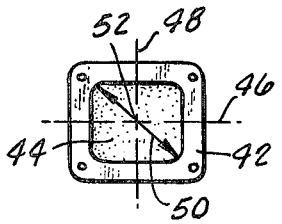
FIG. 2, is the front view of a non-circular speaker showing how the effective diameter thereof is determined.

FIG. 2 is a front view of a speaker 42, having a non-circular piston 44 with a long axis 46 and a short axis 48. When speakers, such as speaker 42, are used in the present invention, the effective diameter of the piston 44 is measured along a diagonal 50 which is the largest diagonal of the piston 44 which intersects the junction 52 of the two axis 46 and 48. The junction 52 provides the point from which to measure the critical distance 20, and speakers, such as speaker 42, should be oriented in the cabinet 28 with either their short axes 48 or their long axes 46 aligned along the vertical.

Figure 3:
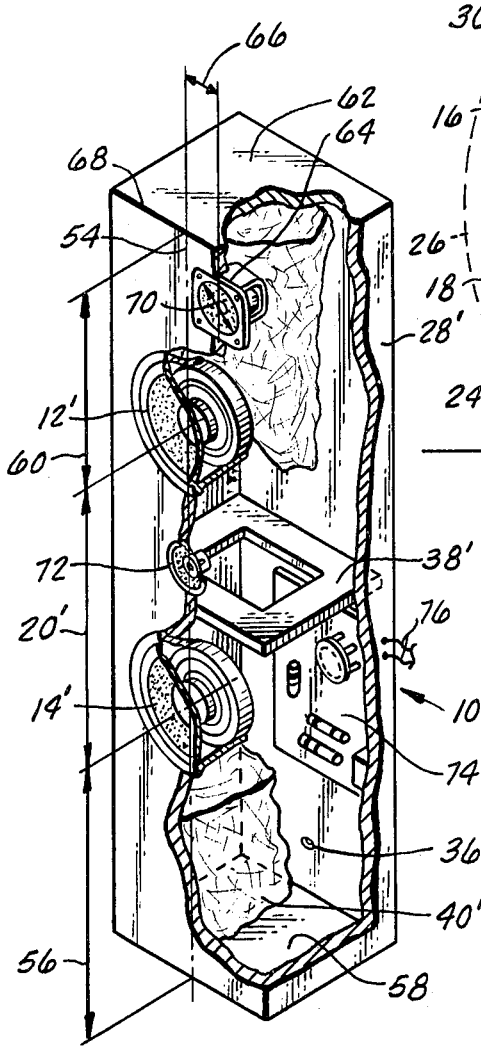
FIG. 3, is a perspective view, partially cut away, of a speaker enclosure constructed according to the present invention.

FIG. 3 shows a typical speaker enclosure 10' constructed according to the present invention, having those portions thereof which are shown in FIG. 1 given the same number with a prime (') added thereto. The enclosure 10' includes a cabinet 28' having two low frequency drivers 12' and 14' in vertical alignment along line 54, a distance 20' which is $\pi$ times the effective diameter of the pistons of the drivers 12' and 14'. The cabinet 28' includes an internal ring shaped baffle 38' connected to the inner side walls of the cabinet 28' between the two drivers 12' and 14' but not an equal distance therebetween. Insulation 40' is included in the cabinet 28' as shown to dampen any tendency for standing waves to form within the cabinet 28'. A tapered hole 36' is provided to prevent low frequency drivers 12' and 14' from pressurizing the cabinet 28'.

As can be seen, the cabinet 28' is rectangular in shape. In an actual operative embodiment of the present invention, the height of the cabinet was 24 inches, the depth 6 inches and the width $5\frac{1}{2}$ inches, while low frequency drivers had approximately 5 inch diameter cones or pistons.

It should be noted that the drivers 12' and 14' are located so that the distance 56 between the lower driver 14' and the base 58 of the cabinet 28' is less than the critical distance 20' but greater than the distance 60 from the center of the upper driver 12' to the top 62 of the cabinet. This dimensional relationship also assists in detuning the cabinet 28' so that resonances are not produced thereby. In the present invention, it is desired that the cabinet 28' do nothing more than support the speakers in their critical positions so that various frequencies are not amplified or nulled by resonances of the enclosure 10'.

In the actual speaker enclosure 10' depicted in FIG. 3, a 2 inch cone high frequency driver 64 is included above the upper low frequency driver 12' and out of vertical alignment a horizontal distance 66 which is approximately $\frac{3}{8}\pi$ times the effective piston diameter of the low frequency driver 12' or 14', and a distance from the cabinet edge 68 no greater than the diameter 70 of the cone high frequency driver 64. The cone driver 64 is employed for enhancement of the midrange frequencies and is mounted off the vertical axis 54 to prevent Doppler effect. Due to its placement in the corner of the cabinet 28', the cone driver 64 produces corner refraction to increase dispersion by means of off axis output. This produces a field effect rather than a sound beam projection.

Also included is a dome driver 72 which can be colocated between the drivers 12' and 14' and on the axis 54 because dome drivers exhibit polar dispersion. The dome driver 72 is used to produce the highest frequencies.

Also shown in the cabinet 28' is a cross-over network 74 which takes the electronic signals, input thereto on lines 76, and distributes the signals to the speakers 12', 14', 64 and 72 with appropriate amplitudes. Such cross-over networks are well known in the art and those having relatively flat and non-abrupt cross-over points are those most desirable for inclusion in the present invention.

Figure 4:
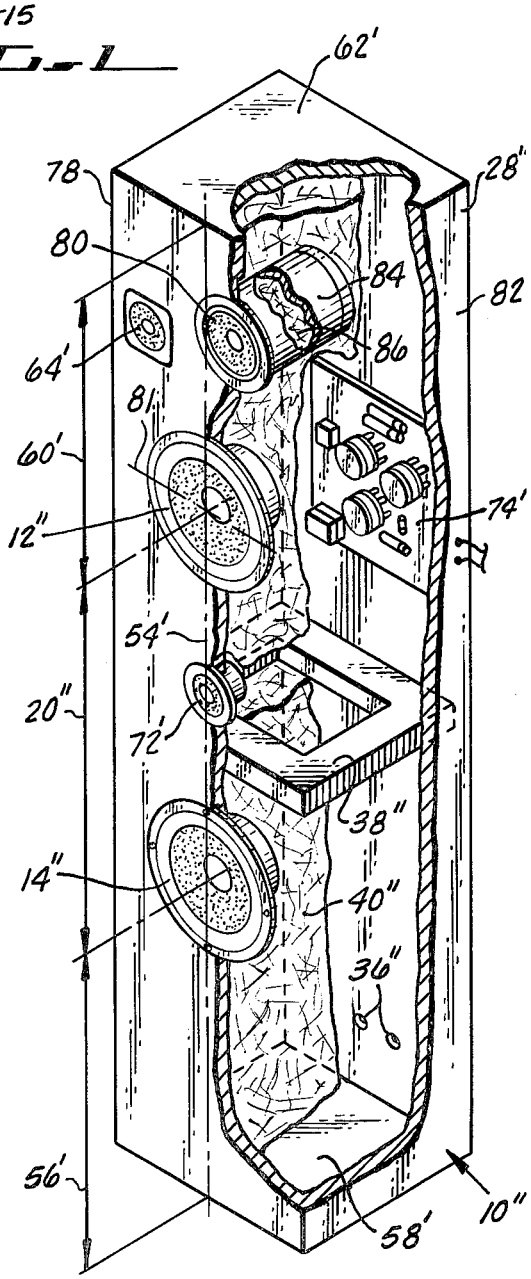
FIG. 4, is a view similar to FIG. 3, of a more complex speaker enclosure constructed according to the present invention.

FIG. 4 shows a larger more complex and more expensive version of the present invention than that shown in FIG. 3. The features first described in FIG. 1 are given the same numberals with a double prime (") added thereto and the numbered features first described in FIG. 3 are given the same numberals with a single prime (') added thereto. The speaker enclosure 10" includes low frequency drivers 12" and 14" which are spaced from the cabinet's top 62' and bottom 58' and from each other, distances 20", 56' and 60' having the same relationships as those distances in FIG. 3. The enclosure 10" includes a baffle 38" having a large percentage open area, insulation 40" filling the open area within the cabinet 28", only partially shown for convenience, and tapered ports 36" to prevent pressurization of the interior of the cabinet 28". Also included is a high frequency dome driver 72' and a suitable cross-over network 74' to feed the proper electrical signals to the active speaker elements of the enclosure 10". In the enclosure 10", the high frequency cone driver 64' is located within a distance equalling the cone diameter to the side edge 78 of the cabinet 28" and off the axis 54' along which lie the drivers 12", 14" and 72'.

The particular construction of enclosure 10" includes a filler driver 80 which is mounted above the horizontal plane 81 of the upper low frequency driver 12' opposite the cone driver 64' and approximately equidistant from the top 62' and the adjacent side 82 of the cabinet 28". As shown, it is preferable that the filler driver 80 include its own enclosure 84 which includes sound deadening material such as glass wool insulation 86 therein to prevent pressure distortion within the cabinet 28".

In the actual production embodiment of enclosure 10" the height of the cabinet is 48 inches, the width 11 inches and the depth $9\frac{1}{2}$ inches, while 8 inch cone drivers are used for drivers 12" and 14". A 1 inch Mylar dome driver was used for driver 72', a 2 inch cone high frequency driver was used for driver 64' and a $4\frac{1}{4}$ inch cone driver was used for the filler driver 80.

Figure 5:
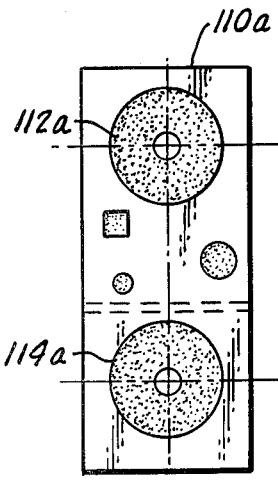
FIGS. 5 and 6 are front views of typical mirror image pairs of speaker system enclosures constructed according to the present invention.
Figure 6:
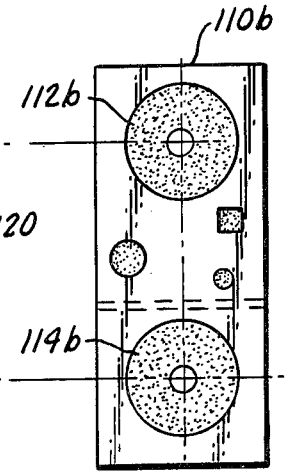

FIGS. 5 and 6 are examples of typical speaker enclosure pairs, **110*a* and 110*b* constructed according to the present invention. The low frequency drivers 112*a* and 112*b* and 114*a* and 114*b* are vertically spaced the aforementioned critical distance 120. However, the higher frequency speakers are arranged in a mirror image fashion as is typical when speaker pairs are employed in a stereo-hi-fidelity system. It should be noted that enclosures 110*a* and 110*b* of FIGS. 5 and 6** have the higher frequency speakers located between the low frequency drivers in a reduced array. This can be done to further reduce the required overall size of the enclosure but with a penalty in the high frequency sound reproduction.

Thus there has been shown and described novel arrays of loudspeakers which fulfill all of the objects and advantages sought therefor. Many changes, modifications, variations and other uses and applications of the subject invention will, however, become apparent to those skilled in the art after considering the foregoing specification together with the accompanying drawing and claims. All such changes, modifications, variations and other uses and applications which do not depart from the spirit and scope of the invention are deemed to be covered by the invention which is limited only by the claims that follow.

What is claimed is:

1. Means for converting electrical vibrations into sound including:

a cabinet;

a first driver having a center and a predetermined effective piston diameter mounted to said cabinet;

a second driver having a center and a predetermined effective piston diameter similar to said piston diameter of said first driver, said second driver being mounted to said cabinet vertically from said first driver a distance center to center which is generally $\pi$ times the similar piston diameter; and means to connect at least one of said drivers to a source of electrical vibrations.

2. The means defined in claim 1, including a second cabinet; and drivers positioned in said second cabinet in sideways mirror image to said drivers in said first cabinet.

3. The means defined in claim 1, further including:

a higher frequency dome driver having a center located in said cabinet in alignment with the centers of said first and second drivers and equidistant therebetween.

4. The means defined in claim 3 including a second cabinet; and drivers positioned in said second cabinet in sideways mirror image to said drivers in said first cabinet.

5. The means defined in claim 1 further including:

a third driver for generating sound at higher frequencies than said first and second drivers which are the lowest frequency drivers of said means, said third driver, having a center and an effective diameter and being located in said cabinet with its center out of vertical alignment with said first and second drivers.

6. The means defined in claim 5 including a second cabinet; and drivers positioned in said second cabinet in sideways mirror image to said drivers in said first cabinet.

7. The means defined in claim 5 wherein the center of said third driver is out of vertical alignment with the centers of said first and second drivers a horizontal distance generally equal to three-eighths the distance between the centers of said first and second drivers.

8. The means defined in claim 7 wherein said third driver is a cone driver and said cabinet has a top, said third driver being located with its center at least as close to said top as said effective diameter thereof.

9. The means defined in claim 5 wherein said cabinet includes opposite sides, said means further including:

a filler driver having a center which filler driver is mounted to said cabinet with its center out of vertical alignment with the centers of said first and second drivers a horizontal distance which is less than the distance the center of said third driver is out of alignment with the center of said first and second drivers in an opposite horizontal direction than said third driver is out of alignment and generally equidistant from the adjacent side and top.

10. The means defined in claim 9 wherein said center of said third driver is located a distance from the adjacent side generally equal to the effective diameter thereof.

11. The means defined in claim 9 further including:

a higher frequency dome driver having a center located in said cabinet in alignment with the centers of said first and second drivers and equidistant therebetween.

12. The means defined in claim 9 including a second cabinet; and drivers positioned in said second cabinet in sideways mirror image to said drivers in said first cabinet.

13. The means defined in claim 1 wherein said cabinet has a front panel defining at least first and second openings in which said first and second drivers are mounted respectively, a top, and a bottom, said first and second openings being positioned so the centers of the first and second drivers are at different distances from the top, from the bottom and from each other.

14. The means defined in claim 13 wherein the distance between the center of the lower of said drivers and the bottom is greater than the distance between the center of the upper of said drivers and the top and less than the distance between the centers of said first and second drivers.

15. The means defined in claim 13 wherein said cabinet includes a horizontally oriented baffle defining an opening of predetermined area therethrough located in said cabinet non-equidistant between the centers of said first and second drivers.

16. The means defined in claim 4 wherein said cabinet includes:

a back defining at least one tapered hole therethrough; and sound absorbing material within said cabinet.

17. The means defined in claim 15 including a second cabinet; and drivers positioned in said second cabinet in sideways mirror image to said drivers in said first cabinet.

18. The means defined in claim 13 wherein the distance between the center of the lower of said drivers and the bottom is greater than the distance between the center of the upper of said drivers and the top and less than the distance between the centers of said first and second drivers, said cabinet including a horizontally oriented baffle defining an opening of predetermined area therethrough located in said cabinet non-equidistant between the centers of said first and second drivers.

19. The means defined in claim 18 wherein said cabinet includes:

a back defining at least one tapered hole therethrough; and sound absorbing material within said cabinet.

20. The means defined in claim 18 including a second cabinet; and drivers positioned in said second cabinet in sideways mirror image to said drivers in said first cabinet.

21. The means defined in claim 18 further including:

a third driver for generating sound at higher frequencies than said first and second drivers which are the lowest frequency drivers of said means, said third driver, having a center and an effective diameter and being located in said cabinet with its center out of vertical alignment with said first and second drivers.

22. The means defined in claim 21 wherein the center of said third driver is out of vertical alignment with the centers of said first and second drivers a horizontal distance generally equal to three-eighths the distance between the centers of said first and second drivers.

23. The means defined in claim 22 wherein said third driver is a cone driver and said cabinet has a top, said third driver being located with its center at least as close to said top as said effective diameter thereof.

24. The means defined in claim 21 wherein said cabinet includes opposite sides, said means further including:

a filler driver having a center which filler driver is mounted to said cabinet with its center out of vertical alignment with the centers of said first and second drivers a horizontal distance which is less than the distance the center of said third driver is out of alignment with the center of said first and second drivers in an opposite horizontal direction than said third driver is out of alignment and generally equidistant from the adjacent side and top.

25. The means defined in claim 24 wherein said center of said third driver is located a distance from the adjacent side generally equal to the effective diameter thereof.

* * * * *